United States Patent [19]

Reid

[11] Patent Number: 5,044,625

[45] Date of Patent: Sep. 3, 1991

[54] ACTIVE TAMPER FOR BIDIRECTIONAL SORTER

[75] Inventor: Paula E. Reid, Rochester, N.Y.

[73] Assignee: Xerox Corporation, Stamford, Conn.

[21] Appl. No.: 521,873

[22] Filed: May 11, 1990

[51] Int. Cl.[5] ..... B65H 39/10

[52] U.S. Cl. ..... 271/293; 271/294; 271/222; 271/224; 270/52; 270/53

[58] Field of Search ..... 291/221, 222, 224, 250, 291/287, 293, 241, 292, 294; 270/52, 53

[56] References Cited

U.S. PATENT DOCUMENTS

| | | | |
|---|---|---|---|
| 3,847,388 | 11/1974 | Lynch | 271/174 |
| 3,995,748 | 12/1976 | Looney | 214/6 |
| 4,325,544 | 4/1982 | Magno et al. | 271/221 |
| 4,607,838 | 8/1986 | Matsuyama et al. | 271/221 X |
| 4,681,310 | 7/1987 | Cooper | 270/53 |
| 4,687,191 | 8/1987 | Stemmle | 270/53 |
| 4,844,440 | 7/1989 | Gray | 271/226 |

FOREIGN PATENT DOCUMENTS

| | | | |
|---|---|---|---|
| 0154576 | 6/1988 | Japan | 271/294 |
| 0231759 | 9/1989 | Japan | 271/293 |
| 2173483 | 10/1986 | United Kingdom . | |

*Primary Examiner*—H. Grant Skaggs
*Assistant Examiner*—C. Druzbick

[57] ABSTRACT

A bi-directionally vertically bin indexed multi-bin sheet sorter, for a fixed position sheet output, such as a copier or printer, with a sheet edge alignment registration jogging system for tamping sheets which are in the immediately previously loaded bins directly above or below the bin being loaded (the bin adjacent the fixed sheet output) concurrently with that bin being loaded but without interfering with the feeding of the sheet into that bin. A single jogging system is stationarily mounted adjacent the sheet output to intermittently horizontally move a jogging member (which extends vertically alongside all three of these adjacent sorter bins) into the above and below bins for tamping sheets therein towards a registration position, such as a corner stapling position, but is configured to not extend into the sheet feeding path and to not tamp sheets in the bin being loaded. It may be a thin, lightweight, flexible, flag-shaped member with two active tamping surface portions separated by a central missing portion in the area of the bin being loaded.

7 Claims, 2 Drawing Sheets

ACTIVE TAMPER FOR BIDIRECTIONAL SORTER

Figure 1:
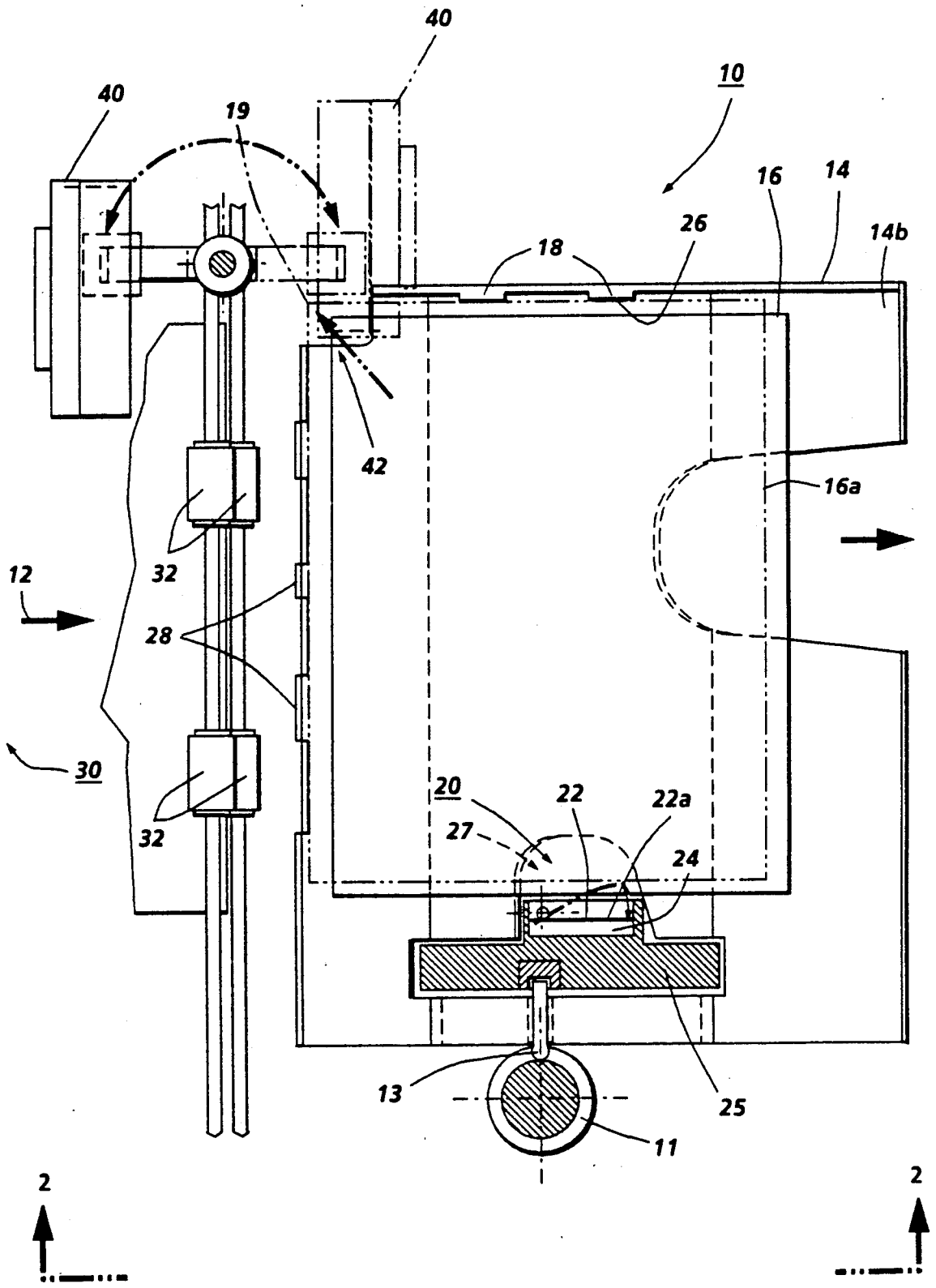

The present invention relates to an improved plural bin sorter or collator for collating or collecting sheets of paper or the like into sets of sheets in respective bins, especially for the output of a copier or printer, with an improved system for actively tamping or jogging the sheets being accumulated in the sorter bins into a desired registration position or alignment without interfering with incoming sheets entering the bins. It provides a system for improved physical control of sheets of printed copy paper or other such flimsy and delicate sheets being stacked, with less danger of document edge damage or image smearing or interference with the bin access by the operator and improved operator safety.

This disclosed system is particularly useful for a sorter for the output of a copier or printer. It is especially appropriate and useful for a bidirectional sorter, in which sequentially a sheet may be fed into each bin as the bin set or array is moved in either direction past a sheet output position. An early example of a moving bins bidirectional sorter per se is shown in Xerox Corporation U.S. Pat. No. 3,788,640. The particular exemplary sorter/stapler shown herein is the subject of Xerox Corporation U.S. Pat. No. 4,681,310, issued July 21, 1987, to Thomas F. Cooper. This is a desirable feature to improve collation speed and reduce copying delays. The disclosed system is particularly especially useful for such sorters with in-bin compiling and/or stapling capability.

Although the present system can be used with various stacking systems, including those which provide offsetting or lateral offsetting into job sub-sets of the sheets being stacked, the disclosed system is particularly desirable for a compiler for a finisher. More positive and accurate stacking by sheet edge registration assistance has become even more desirable, especially for compiling. Sheets often enter a stacking tray with uneven lateral offset, or skew, or uneven sizes. In a compiler tray or area a stack of sheets must be closely stacked and neatly and evenly aligned to at least one edge for stapling, gluing or other binding or finishing operations, there or subsequently. Such set finishing per se is well known, as noted, e.g., in the patents cited in U.S. Pat. No. 4,782,363 at Col. 13 lines 1–27, inter alia. In compiling, and many other sheet stacking processes, it is desirable to be able to stack from two sheets up to a large number of sheets in sets with very close stack registration dimensions, e.g., with all sheets in a set aligned to within a fraction of a millimeter on at least one edge, to avoid ragged or uneven looking stack edges in the finished sets. It is also desirable to be able to stack and register sheets rapidly, in the time available between sequentially fed sheets without slowing down the sheet production. It is also desirable to be able to do so with a relatively simple and low cost apparatus, yet with high reliability, absence of document edge damage or image smearing or operator danger, and accommodating a wide range of paper sheet sizes and weights and/or stiffnesses. It is also desirable to be able to accommodate a wide range of stack heights and to be able to compile large sets or stacks of sheets (e.g., up to 250 or more sheets) without requiring adjustment or resetting of a tamper or jogger or other compiler mechanisms position relative to the stack or tray as the stack height changes.

Integral compiling and stapling capability directly in a sorter bin itself is a known feature desirable in some post-collation copying or printing systems, in which pre-collation original document recirculation is not desirable or not available. One recent example is of such a bidirectional sorter with in-bin compiling and/or stapling capability is disclosed Xerox Corporation U.S. Pat. No. 4,925,171 issued May 15, 1990. That patent also cites some other examples of providing on-line post-collation stapling by stapling sorted copy sets after they are sorted in the trays or bins of a copier. They include U.S. Pat. No. 4,083,550 issued Apr. 11, 1978 to R. Pal, and U.S. Pat. No. 4,762,312 issued Aug. 9, 1988 to Y. Ushirogatn (Ricoh), also disclosing moving a loaded bin of a sorter out from the bin array towards a stapler for stapling. Withdrawal of the sets from the bins with a gripper extractor for stapling elsewhere is shown for example in U.S. Pat. No. 4,361,393 to Noto. Of even greater interest, for showing directly in-bin stapling systems, with vertically moving bin bidirectional sorter bin arrays, are Xerox Corporation U.S. Pat. No. 4,681,310 to Cooper, and 3,995,748 to Looney. Also, Xerox Corporation U.S.Pat. No. 4,687,191 issued Aug. 18, 1987, and UK 2 173 482-A published Oct. 15, 1986, both by Denis Stemmle, are both on in-bin stapling. Edge jogging and glue binding sets in a sorter or collator is disclosed in Snellman et al U.S. Pat. No. 4,145,241. Hamlin et al U.S. Pat. No. 4,564,185 shows an on line rotary sorter copier unit with in-bin glue binding and/or stapling of the post-collated copy sets. U.S. Pat. No. 3,884,408 to L. Leiter et al. and U.S. Pat. No. 3,944,207 to Bains show a moving stapling system with a fixed horizontal bin array sorter.

An example of a pivotal or swing-in stapler usable for in-bin stapling of a sheet set compiled in one accessible corner of the bin is disclosed in Xerox Corporation U.S. Pat. No. 4,830,256.

By way of further background, various paddle wheel or other scuffer type compiler or other stacking assistance systems are known in the art, e.g., Xerox Corporation U.S. Pat. No. 3,847,388 issued Nov. 12, 1974 to T. Lynch, or the driven flexible or floppy endless belt sheet aligning web member 50 disclosed in Canon U.S. Pat. No. 4,883,265 issued Nov. 28, 1989 to N. Iida, et al., etc. Some additional examples of active, in-bin active set jogging or scuffer registration systems for sorters, per se, include Xerox Corporation U.S. Pat. No. 4,087,087 issued May 2, 1978 to John Looney on frictional scuffers, and the Eastman Kodak Ektaprint 150PS bidirectional sorter jogging system. The latter has, at opposite (front and back) sides of the vertical sorter bin array, on opposite sides of the paper entrance path, a pivotally closing front stop gate vertical bar and a reciprocated rear vertical tamping bar, vertically extending past the front and back of all the the bins, respectively. The rear bar is intermittently jogged towards the front bar when it is in position to jog all the stacks in the bins. This relatively complex set registration system (which also undesirably restricts access to all the bins for set removal until this front stop gate is opened), is apparently to avoid obstruction of the paper entrance path to the bins, and illustrates advantages of the much simpler system disclosed herein.

A resilient brush tamper arm corner jogger for a stapling bin is disclosed in Xerox Corporation U.S. Pat. No. 4,844,440, issued July 4, 1989, to John R. Grey.

Various other sheet stack edge joggers per se are also known, e.g. U.S. Pat. Nos. 4,318,541, 4,431,177, and 4,556,211.

Disclosed herein, in sorter system with plural sorting bins (sheet compiling trays) movable as a unit relative to a fixed sheet entry or bin input (bin loading) position, is an active jogging system system for automatic jogging of the sheets in the bins without interfering with the sheet entry or bin input to provide desired set registration. That set registration may be into a desired lateral and/or stapling position.

The present system is not limited to any particular sorter bin movement or loading system, and is applicable to various known or other sorters. The sorter bins may be conventionally mounted for common vertical movement in a common mounting bin array with appropriate inter-bins spacing, especially at the bin loading position, as shown in the art.

Some examples of recent Xerox Corporation U.S. patents on sorter with bins which pivot to automatically open or expand the inter-bin spacing adjacent the sheet entry or input position include U.S. Pat. Nos. 4,558,860 (used with the Xerox Corporation "5028" copier); 4,772,009 and 4,398,712, Gradco Systems, Inc. U.S. Pat. No. 4,478,406, or the like. Other such art is noted therein, and in the above-cited U.S. Pat. No. 4,925,171. The type of sorter in which a large or substantial number of bins can all be reciprocally vertically moved as a bin unit or array relative to a fixed sheet input, with a sheet input with a desirably constant sheet input path distance and transit time, is shown for example in Xerox Corporation U.S. Pat. No. 3,788,640. Other well known types of sorters in which the sheet must be transported past a variable number of bins by a variable distance until it reaches a selected bin pivoted open to receive it include Xerox Corporation U.S. Pat. No. 4,133,522.

The disclosed sorter is merely exemplary of various sorters suitable for conventional, known, post-collation sorting of the copy sheet output of various copiers. Thus, neither need be disclosed in any detail here. That is, any copier with operatively connected auxiliary plural sorter bins, in one or more plural bin arrays, sets or modules, in which copier a set of documents are plurally copied, for making plural sets of copy sheets therefrom, by making a plural number of identical consecutive copies per document page of the document set and respectively outputting one copy sheet of each of the first document page copies to a separate sorter bin, then feeding one each of the next page copies to each of said same plural sorter bins, etc., until the completed collated copy sets are accumulated as an individual stacked set in each of the bins used. However, it should be noted that sorters may also be optionally used for accumulating uncollated stacks of plural identical copies in each bin, if desired. Also, sorter bin loading from the copier output or other uncollated sheet input source may be paused at selected operating points for manual or automatic inserts of covers, tabbed sheets, photos, colored separators, or the other inserts.

The disclosed sorter and copier may be readily operated or controlled in a conventional manner with conventional control systems. Some additional examples of various prior art copiers with control systems therefor, including sheet detecting switches, sensors, etc., are disclosed in U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute copier control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either the provided verbal functional descriptions, such as those provided herein, or prior knowledge of those functions which are conventional, together with general knowledge in the software and computer arts. Controls may alternatively be provided utilizing various other known or suitable hard-wired logic or switching systems.

A specific feature disclosed herein is to provide, in a multi-bin sorter with means for sequentially feeding a sheet of paper or the like in a sheet feeding path from a fixed sheet output such as a copier or printer sequentially into one said bins adjacent thereto, and wherein said bins are reciprocally indexable in two directions relative to said fixed sheet output, to accumulate stacked sheet sets in respective said sorter bins, and further including a sheet edge alignment registration jogging system, the improvement wherein said sheet edge alignment registration jogging system comprises tamping means for tamping those sheets which are in said sorter bins which are above and below said one said bin adjacent to said fixed sheet output into which a sheet is being so fed without interfering with said feeding of a sheet into said one said bin.

Other specific features disclosed include those wherein said tamping means is stationarily mounted and comprises a tamping member extending alongside said sorter bins which are above and below said one said bin adjacent to said fixed sheet output, which tamping member is intermittently movable into those bins for tamping sheets therein towards a registration position but is configured to not extend into said sheet feeding path and to not tamp sheets in said one said bin adjacent to said fixed sheet output, and comprises a tamping member extending alongside said sorter bins which are above and below said one said bin adjacent to said fixed sheet output, and/or wherein said tamping member has two active tamping surface portions separated by a central missing portion, and/or wherein said tamping member is a pivotally rotated, generally vertical, centrally apertured, resilient, light weight, large area flag shaped flapper, and/or wherein said tamping means jogs sheets which are in said sorter bins which are above and below said one said bin adjacent to said fixed sheet output into a corner stapling registration position in said bins, and/or said bins are vertically inclined from the horizontal to provide two-axis corner sheet registration with a single said tamping means tamping substantially on one axis, and/or wherein said bins have two differently vertically inclined bin surface portions with the bin surface portion furthest from said fixed sheet output having the greater said vertical inclination.

All references cited in this specification, and their references, are incorporated by reference herein where appropriate for appropriate teachings of additional or alternative details, features, and/or technical background.

Figure 2:
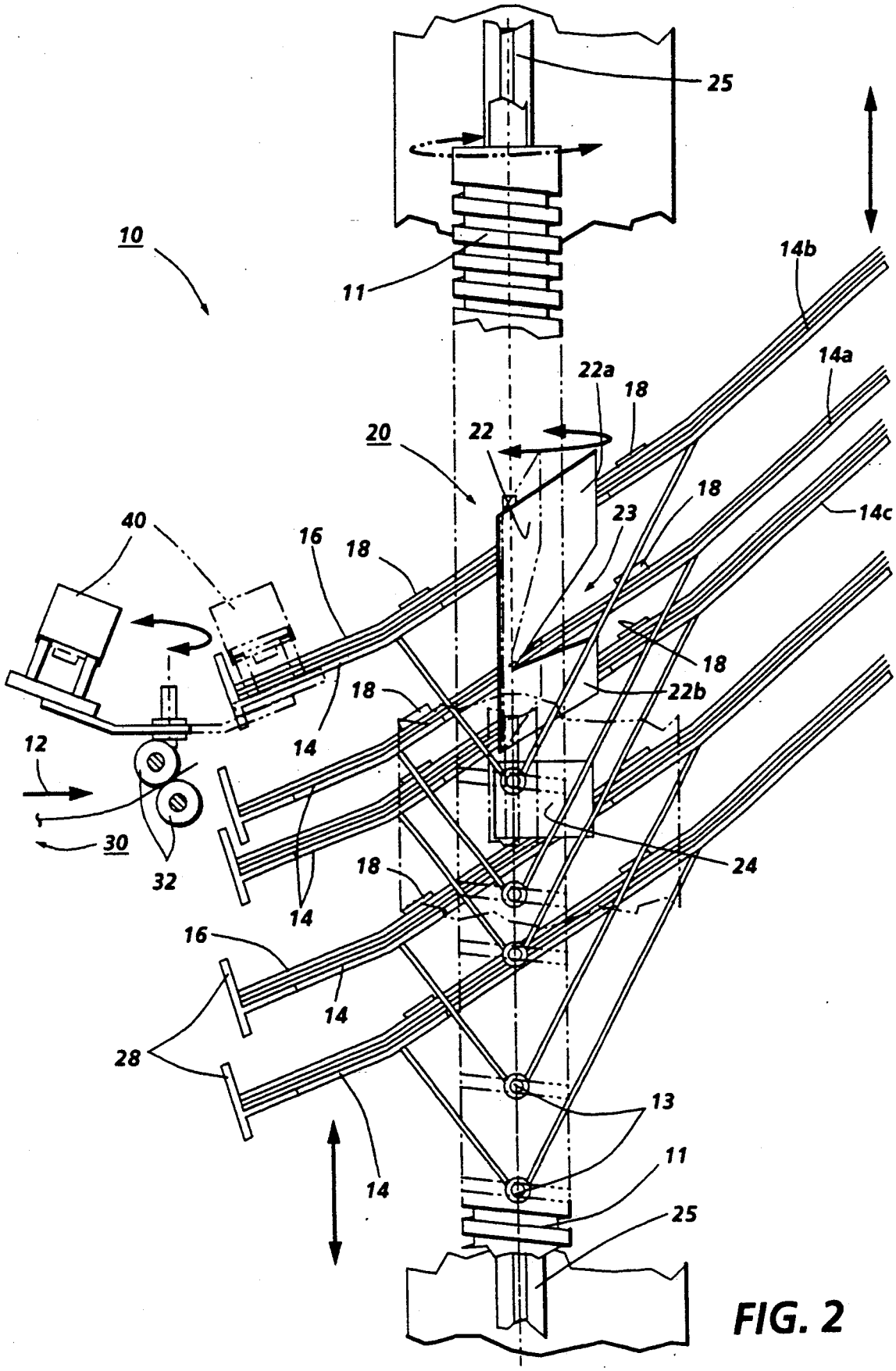

Various of the above-mentioned and further features and advantages of the invention will be apparent from the apparatus and its operation described in the specific example below. Thus, the present invention will be better understood from the following description of this exemplary embodiment thereof, including the drawing figure (approximately to scale) wherein:

FIG. 1 is a schematic top or plan view of one example of a bidirectional plural bin sorter and integral lateral sheet registration jogger system in accordance with the present invention, with an in-bin corner stapler, and FIG. 2 is a rear view thereof (a view from the rear side of the sheet path into the sorter).

Describing now in further detail the specific example illustrated in the Figures, there is schematically shown one exemplary sorter 10 with bins 14 sequentially fed sheets via a fixed position sheet input path 12 integral the output of a copier 30. The exemplary copier 30 may be, for example, various of the well known Xerox Corporation copiers, as illustrated and described in various patents cited above and otherwise, such as U.S. Pat. No. 4,278,344, or various other xerographic or other copiers or printers. Thus only the output or exit feed rollers 32 of the copier are shown here providing the sheet input path 12, functioning as the feed-in rollers feeding sheets into the bin being loaded. (These feed-in rollers may alternatively be separate sorter module feed rollers instead, especially if this sorter 10 is a separate modular sorter unit.).

Here, all of the sheets stacked in all of the bins are laterally (side) registered and aligned by the disclosed lateral sheet registration active jogging system 20. The outline of one size of sheet being stacked is shown in FIG. 1 at 16. The solid line position is an exemplary initial bin position of the sheet 16, and the phantom line position 16*a* of sheet 16 is its registered position. The illustrated jogging system 20 here includes a special tamping member 22 intermittently rotatably driven against one edge of the sheets by a solenoid tamper drive 24. This may have a spring return to keep the tamping member 22 out of the way as the bins index. The movement drive force and/or impact of the tamping member 22 on one side of a sheet jogs the opposing edge of the sheet, especially the last loaded, top, sheet in the bin, into a side registration position or line 26. Here the sheets are jogged by a preset suitable offset distance of, say, about 5 mm into a registration corner position 19 in area 42. Here the side registration line 26 is defined by a registration vertical side stop wall or fingers 18. Alternatively, or additionally, the side registration stop line 26 may be provided by the back of the open jaw of a stapler 40 provided at a corner registration stapling cutout area 42 in the trays 14, as shown. The stapler 40 may be intermittently pivoted into that position 42 for completed set stapling, as shown in the cited and other art.

The details of the solenoid 24 or other actuation system for moving tamping member 22 are not important, since obviously various rotary or other solenoids or motors or cams can be utilized to actuate this tamper 22.

For illustration clarity a relatively small plurality of sorter 10 bins 14 is illustrated here, although it will be appreciated that the disclosed active tamper lateral sheet registration jogger system 20 here is very suitable for a sorter with a much larger number of bins operated in the same manner, since only one active jogger or tamper system may serve all of the bins in this disclosed jogger system 20. The jogger system 20 here is not plural units mounted to the moving bins or in each bin. Rather the jogger system 20 fixedly mounted at one side of the bin input position 12, out of the sheet entrance path, adjacent one side of the sorter 10 array, and not moving therewith. This is a system particularly suited for a "moving bin" sorter with an array of moving bins, all of which can be provided here with edge jogging by a single tamper mechanism fixed adjacent the sheet output of the copier or printer. As shown, the system 20 may be mounted to the fixed rail guides or supports 25 of the sorter 10. In other designs, it could be mounted to the copier 30.

All the plural individual sorting bins 14 (sheet compiling trays) of the sorter 10 are commonly vertically reciprocally movable as an integral unit in a suitable known manner by a simple conventional vertical drive system as shown in the cited and other art. Here, this is a single helical screw drive 11. Attached to each bin 14 are pins 13 which ride the helix drive 11. This moves the bins 14 bidirectionally past the fixed sheet entry or bin input (bin loading) position 12 depending on the direction of rotation of drive 11. The sorter 10 is conventionally operated such that as each bin 14 passes or comes adjacent to and pauses by this bin input position 12, a sheet from the copier 30 is loaded therein via the rollers 32, and then the sorter indexes up or down to position the next, adjacent, bin there for loading. The bin 14 being loaded may be conventionally automatically moved further away from the adjacent bin to provide an enlarged bin entry opening at the entry side thereof, the side adjacent the input position 12 (the side facing the copier 30), as shown in the above and other art. E.g., by a variable pitch in helix drive 11 for that area, as shown.

For illustration here, the bin 14 shown being loaded here is labeled 14*a*, the next bin directly above is labeled 14*b*, and the bin directly below is labeled 14*c*. If the bins 14 are moving up while loading, then bin 14*b* was just previously loaded with one sheet just before the loading of bin 14*a*. If the bins 14 are moving down while loading, then bin 14*c* just previously completed loading one sheet just before the loading of bin 14*a*.

Further to the illustrated active tamper lateral sheet registration jogger system 20, the tamping member 22 has a special and unique configuration. It is preferably of low mass yet large sheet contacting area, to avoid impact damage to the edges of low mass sheets, yet be capable of transmitting a sustained pushing force sufficient to move a low mass sheet several mm by sustained application of its solenoid drive 24 thereto, e.g., approximately 0.15 kg held for approximately 250 ms. The tamping member 22 here has an unusual plural bin vertical dimension, which dimension is in excess of the three bin spacing of the bin 14*a* being loaded and the adjacent above and below bins 14*b* and 14*c*, including any extra bin opening which may be provided for loading as noted above. The tamping member 22 is preferably made of a thin flexible resilient plastic or metal sheet or the like, e.g., 0.0125 inch thick Mylar TM, with, e.g., a modulus of 340,000. The tamping member 22 is cantilever mounted from one edge for rotation about the rotating drive shaft of the rotary solenoid tamper drive 24. Thus, the tamping member 22 defines, and is referred to herein as, a tamping arm, tamper, flapper, or flag. When the solenoid drive 24 is actuated, this tamping flapper or flag 22 is resiliently pressed against one side edge of at least the last sheets stacking in both bins 14*b* and 14*c*, to provide the sheet edge jogging discussed above.

This tamping member 22 has a further unique configuration and feature. It has a central cut out or notch or aperture 23. (Alternatively, this may be considered or constructed as a space 23 between two separate spaced upper and lower tamper flags or arms 22*a* and 22*b*.) The configuration and spacing of the tamping system 20, enabled by the aperture 23 and two separate active jogging portions 22*a* and 22*b*, is such that it does not obstruct bin loading (sheet entrance into the bin 14*a*), yet tamps the adjacent bin 14*b* and 14*c* sheet stacks. That is, the resilient flapper 22 is centrally cut out at 23 so as not to hit the sheet coming into the bin 14*a* being loaded, yet tamp or jog sheets in the trays 14*b* above and 14*c* below the tray or bin 14*a* in which a sheet is being loaded at that particular time. Even when the flapper 22 is swung into the tray stacking area for tamping, only the top and bottom portions 22*a* and 22*b* of flapper 22 respectively adjacent trays 14*b* and 14*c* can contact sheets, whereas a sheet entering tray 14*a* will simply pass unobstructed through the aperture 23, which is aligned with tray 14*a*. Thus, only trays 14*b* and 14*c* are tamped. Yet since both trays 14*b* and 14*c* are tamped, tamping is provided for bidirectional sorting.

Note that each tray 14 preferably has a notch or cut out area 27 extending into the sheet stacking area in the path of the flapper 22. Thus, the flapper 22 can unobstructedly swing into the tray stacking area to hit sheet edges without initially hitting any tray 14 edge.

The vertical inclination or slope of the trays 14, providing what is commonly called "uphill stacking", can provide jogging of the sheets by gravity down towards the illustrated front lip or vertical wall 28 of each tray 14, assisted by the impact and vibration from the jogging system 20 and the tray unit vertical movement. Thus, two-axis or corner registration jogging can be provided here into the registration and stapling corner position 19. Thus complete in-bin jogging or set aligning (compiling) can be provided for stapling. The stapler 40 may desirably be mounted to be operated in one of the two trays 14*b* (as here) or 14*c*, so as to be operating on a sheet set being actively jogged or directly thereafter before undesired accidental sheet shifting can occur from the next bins movement.

Because the operation of this unique tamping system 20 does not ever interfere with or obstruct bin loading or unloading, its timing initiation and actuation time periods can be simple, flexible, and non-critical. It does not have to be tied in to or be regulated by sheet position or bin entrance sensors.

While the embodiment disclosed herein is preferred, it will be appreciated from this teaching that various alternatives, modifications, variations or improvements therein may be made by those skilled in the art, which are intended to be encompassed by the following claims.

I claim:

1. In a multi-bin sorter with means for sequentially feeding a sheet of paper or the like in a sheet feeding path from a fixed sheet output such as a copier or printer sequentially into one said bins adjacent thereto, and wherein said bins are reciprocally indexable in two directions relative to said fixed sheet output, to accumulate stacked sheet sets in respective said sorter bins, and further including a sheet edge alignment registration jogging system, the improvement wherein said sheet edge alignment registration jogging system comprises tamping means for tamping those sheets which are in said sorter bins which are above and below said one said bin adjacent to said fixed sheet output into which a sheet is being so fed without interfering with said feeding of a sheet into said one said bin, wherein said tamping means is stationarily mounted and comprises a tamping member extending alongside said sorter bins which are above and below said one said bin adjacent to said fixed sheet output, which tamping member is intermittently movable into those bins for tamping sheets therein towards a registration position but is configured such that it does not extend into said sheet feeding path and does not tamp sheets in said one said bin adjacent to said fixed sheet output.

2. The multi-bin sorter of claim 1, wherein said tamping member is a pivotally rotated, generally vertical, centrally apertured, resilient, light weight, large area flag shaped flapper.

3. The multi-bin sorter of claim 2, wherein said tamping means jogs sheets which are in said sorter bins which are above and below said one said bin adjacent to said fixed sheet output into a corner stapling registration position in said bins.

4. The multi-bin sorter of claim 1, wherein said bins are vertically inclined from the horizontal to provide two-axis corner sheet registration with a single said tamping means tamping substantially on one axis.

5. The multi-bin sorter of claim 4 wherein said bins have two differently vertically inclined bin surface portions with the bin surface portion furthest from said fixed sheet output having the greater said vertical inclination.

6. In a multi-bin sorter with means for sequentially feeding a sheet of paper or the like in a sheet feeding path from a fixed sheet output such as a copier or printer sequentially into one said bins adjacent thereto, and wherein said bins are reciprocally indexable in two directions relative to said fixed sheet output, to accumulate stacked sheet sets in respective said sorter bins, and further including a sheet edge alignment registration jogging system, the improvement wherein said sheet edge alignment registration jogging system comprises tamping means for tamping those sheets which are in said sorter bins which are above and below said one said bin adjacent to said fixed sheet output into which a sheet is being so fed without interfering with said feeding of a sheet into said one said bin, wherein said tamping means is stationarily mounted adjacent said fixed sheet output and comprises a tamping member extending alongside said sorter bins which are above and below said one said bin adjacent to said fixed sheet output, which tamping member is intermittently movable into those bins for tamping sheets therein towards a registration position but is configured such that it does not extend into said sheet feeding path and does not tamp sheets in said one said bin adjacent to said fixed sheet output by said tamping member having two active tamping surface portions separated by a central missing portion.

7. The multi-bin sorter of claim 6, wherein said tamping member is a piovotally rotated, generally vertical, centrally apertured, resilient, light weight, large area flag shaped flapper.

* * * * *